United States Patent [19]

Nötzel

[11] Patent Number: 5,058,296

[45] Date of Patent: Oct. 22, 1991

[54] CALENDAR

[75] Inventor: Wolfgang Nötzel, Munich, Fed. Rep. of Germany

[73] Assignee: Wohlfahrt GmbH, Rothenburg ob der Tauber, Fed. Rep. of Germany

[21] Appl. No.: 441,164

[22] Filed: Nov. 27, 1989

[30] Foreign Application Priority Data

Nov. 25, 1988 [DE] Fed. Rep. of Germany ... 8814723[U]

[51] Int. Cl.[5] ..... G09D 3/00

[52] U.S. Cl. ..... 40/107; 273/241

[58] Field of Search ..... 40/107; 273/241, 249; 434/207, 191, 245, 304; 116/306, 307, 308, 325

[56] References Cited

U.S. PATENT DOCUMENTS

| | | | |
|---|---|---|---|
| 1,520,648 | 12/1924 | Holt | 40/107 |
| 2,440,062 | 4/1948 | Allen | 40/107 |
| 3,791,649 | 2/1974 | Gold | 273/241 X |
| 4,062,545 | 12/1977 | Witney | 273/241 X |
| 4,147,359 | 4/1979 | King | 273/241 |
| 4,666,162 | 5/1987 | Campbell | 273/241 X |

*Primary Examiner*—Laurie K. Cranmer
*Assistant Examiner*—J. Bonifanti
*Attorney, Agent, or Firm*—Michael Striker

[57] ABSTRACT

A calendar, particularly an Advent calendar comprises a calendar part provided with a stair edge having stair steps which form respective day regions, a marking arranged to mark respective days, the stair steps and the markings being formed so that the marking can be consecutively arranged on the stair steps, and orienting means for orienting the calendar part so that the stair steps extend each in a substantially horizontal direction and are spaced from one another horizontally and upwardly.

12 Claims, 5 Drawing Sheets

8
7

5
6
2
1
8
22

7
21

3
9
4

20
19

17
18

11
12
13
10
23

15
16
14

CALENDAR

BACKGROUND OF THE INVENTION

The present invention relates to a calendar, and particularly to an Advent calendar having a calendar part with day regions arranged at various locations, and a marking movable selectively relative to the calendar part over the respective day regions.

Calendars of the above mentioned general type are known in the art. A known calendar has a sheet-shaped calendar part and days of a month printed in the lines and columns. Such a calendar is disclosed for example in the German document DE-OS 3,121,574. The marking in this calendar is formed as a window which surrounds in a frame-like manner the surface of one day region and is displaceable on a guide over the width of the calender sheet. The guide is clamped on the calendar sheet in a height-adjustable manner. Thereby the window can be displaced from day to day for marking the respective suitable calendar day.

This calendar satisfies the calendar functions by indicating the respective day. However, it requires a line guidance and a column guidance with a special guide for the marking window. Clamping force securing the respective position of the marking window is needed, especially in the case of wall calendar with suspended calendar sheet. The calendar sheet is flexible and requires a more or less rigid substrate or framing with a device for suspending or standing. The calender sheet as a plain surface provides only for graphic design possibilities and only to a limited extent since the calendar sheet surface is substantially used or consumed by the day features. Individual days can not be emphasized or can be emphasized not in a sufficient manner with respect to other days. This is believed to be a reason why this known calendar is not suitable to operate as an Advent calendar.

Advent calendars are known in various embodiments. Conventionally, it is formed of a cardboard material having a plane shape or can be folded or glued as a spatial structure. This is disclosed for example in the German document DE-GM 8,601,801. The calendar has 24 days windows or doors or pockets associated with the days 1 through 24 of December and serve especially for children for preparing daily small surprise gifts. However, the central meaning of the Christmas festivities or the Christmas Night is diminished, even when an attempt is made to emphasize December 24 by a larger door. Here also the possibilities of optical emphasis on a certain day and namely the Holy Night (December 24) or the Christmas Night (December 25) is limited.

SUMMARY OF THE INVENTION

Accordingly, it is an object of the present invention to provide a calendar of the above mentioned general type which avoids the disadvantages of the prior art.

More particularly, it is an object of the present invention to provide a calendar which emphasizes more the day sequence to a certain day or day event and orients a user on a predetermined day.

It is also an object of the present invention to provide such a calendar which is simple to produce and simple to handle, and provides for various design possibilities.

In keeping with these objects and with others which will become apparent hereinafter, one feature of the present invention resides, briefly stated, in a calendar in which a calendar part is rigid and formed with a stair edge provided with stair steps defining the regions of respective days, and the stair steps are dimensioned so that a predetermined marking can be placed on them, and further the calendar part has orienting means for arranging the calendar so that the stair steps extend horizontally and upwardly one after the other.

When the calendar is designed in accordance with the present invention, the individual day or the respective step is connected with other days due to the stair shape optically oriented to reaching of the uppermost step. Thereby the uppermost step obtains a special meaning formed as so-called target for eyes, when the time or the marking advances by one day or one step. Therefore the inventive calendar is suitable especially as an Advent calendar In this case the upper end of the calendar stairs is provided with Christmas motives, such as a crib, the Holy Family and/or a comet. A marking can be formed in this case as an angel whose daily movement over the steps can be achieved by a child's hand with no problems whatsoever. The stair shape provides for a very clear recognition as to the path covered toward the Christmas festivities and a path still to be covered before it. Of course, the steps can be progressively numbered to provide a calendar-type reading of the daily dates and to control accurate positioning of the marking or the angel on the stairs.

The calendar can be made as a standing calendar as well as a wall calendar. With a helical design of the calendar, a relatively small standing surface is required and thereby the Advent calendar can be arranged inside ah Advent wreath.

In accordance with an especially advantageous embodiment, the parts of the calendar can be formed as individual flat plug parts releasably connectable with one another.

The Advent calendar can be made with 24 or 25 stair steps, depending on whether the family or the country celebrates Christmas on the Holy Night or on the first Christmas Day. The Advent calendar can be provided with 28 or 29 stair steps which cover the full Advent time with 4Advent Sundays before Christmas. In this case for special steps, plates are provided to symbolize the Advent Sundays. The calendar can also be provided with 31 steps and for example 5 insertable step plates for Sundays, not only as the calendar for December but also for other months of the year.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 11 shows still a further embodiment of the invention.

DESCRIPTION OF THE PREFERRED EMBODIMENTS

Figures 1, 6, 7:
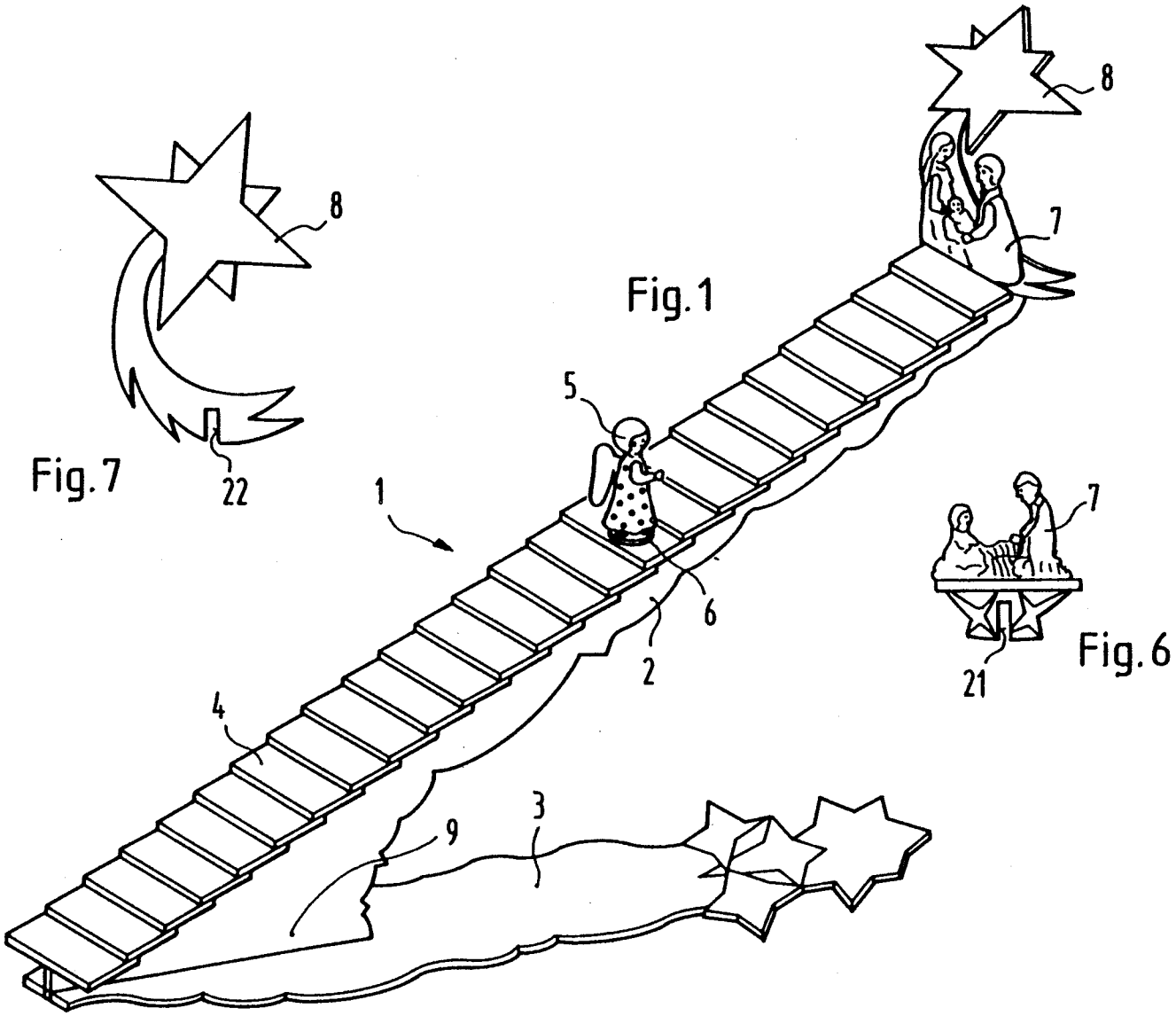
FIG. 1 is a perspective view of an Advent calendar in accordance with the present invention.
FIG. 6 is a view showing a plug part provided for the Advent calendar and releasable therefrom.
FIG. 7 is a view showing a further plug part of the inventive Advent calendar.

An Advent calendar shown in FIG. 1 is identified as a whole with reference numeral 1. It is formed at a standing calendar which can be placed in a standing position for example on a table surface or on a ground. The Advent calendar 1 includes a flat plain calendar part 2, a flat foot part 3, 24, step plates 4, a marking 5 in form of a standing figure with a plain standing surface 6, a first insert part 7 and a second insert part 8. The insert parts 7 and 8 are mounted on the upper end of the calendar part 2 and shown in detail in FIGS. 6 and 7.

The calendar parts 2 are composed of a rigid, flat material and provided on its upper side with a stair edge which is not seen in FIG. 1. A step plate is fixedly connected with each stair step of the calendar part 2, for example by gluing, and uniformly project outwardly beyond both sides of the calendar part 2. At its lower end the calendar part 2 has a supporting portion 9 which extends only underneath the first step plate 4 and is connected with the flat foot part 3. The foot part 3 not only extends outwardly beyond both sides of the calendar part 2, but also extends over a substantial part of the length of the calendar part 2. Thereby a sufficient standing stability is imparted to the Advent calendar 1.

For providing the identification of the calendar 1 as an Advent calendar, the marking 5 is formed as an angel, while the insert parts 7 and 8 represent the Holy Family with a crib and a comet respectively. Also, the calendar part 2 and the foot part 3 are provided with Christmas motives and painted especially with stars, as can be seen on the foot part 3.

FIGS. 2-5 show that the Advent calendar not only has the individual insert parts 7 and 8, but as a whole can be assembled from several flat insert parts, or in other words plug parts. A calendar part 10 of FIG. 2 has an upper stair edge 11 provided with 24 stair steps 12. The upper stair step 13 is elongated so that an insert part can be mounted in the elongation region as can be seen for example in FIGS. 6 and 7. The calendar part 10 has a supporting portion 15 for connecting with a foot part 14 shown in FIG. 3. The supporting portion 15 is insertable into a matching slot 16 of the foot part 14 with a narrow play, so as to provide a holding and at the same time releasable connection between the parts 10 and 14. These parts 10 and 14 have star-like ornaments, which on the one hand determine the contour of the flat parts 10 and 14, and on the other hand, can be painted or glued on.

Figures 2, 3, 4, 5:
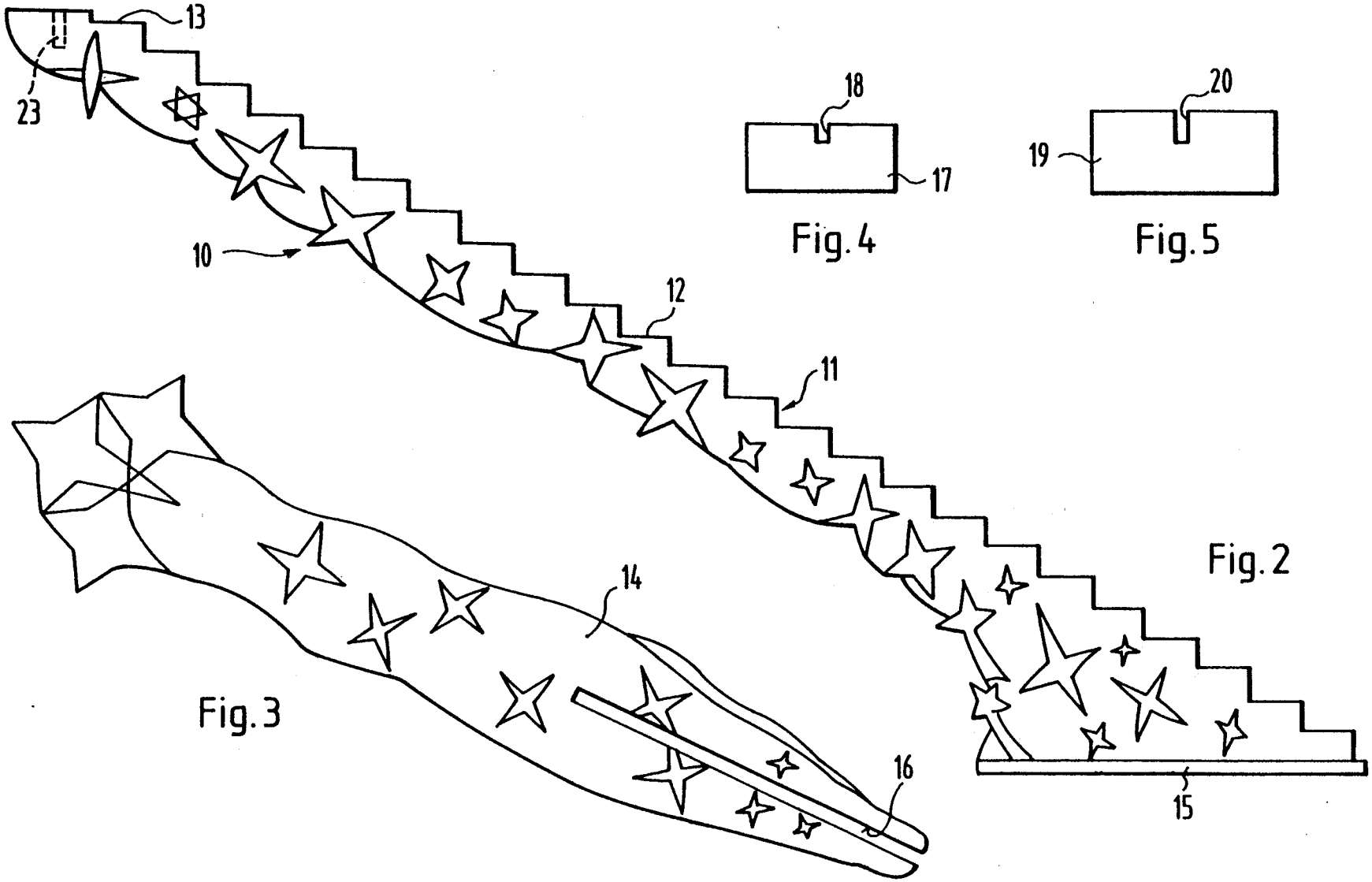
FIG. 2 is a view showing a stair-shaped calendar part from the side suitable for the calendar shown in FIG. 1.
FIG. 3 is a view showing a foot part associated with the calendar part of FIG. 2.
FIG. 4 is a plan view of a stair step to be used with a calendar part of FIG. 2.
FIG. 5 is a view showing a stair step corresponding to that of FIG. 3, but with a different size.

Step plates 17 are further arranged on the calendar part 10. One of the step plates is shown in FIG. 4. The step plates 17 are placed in a horizontal orientation on the stair steps 12 and fitted with an insert slot 18 on a matching width of the calendar part 10. For the elongated uppermost stair steps 13, an abutment is provided which cooperates with a bottom of the insert slot 18 and extends insignificantly beyond it. The step plates 17 for a marking angle 5 have an increased secure stand surface which is larger than the small stair steps 12 so as to prevent the risk of falling down.

FIG. 4 shows a very similar step plate 19 with an insert slot 20 which is however wider and deeper as compared with the step plate 17. The insert slot 20 is elongated in correspondence with the greater depth. Such larger step plates 19 are provided for raising a predetermined stair step and thereby a predetermined day in the calendar course, for example the Sunday inside the Advent time. Thereby the stair is subdivided into portions, which enable a faster orientation in the calendar. Since the fitting or plugging of the step plates 17 and 19 is possible, possibility is provided of adjustment of the calendar to the peculiarities of the respective years. It is to be understood that the step plates 19 of the second type can be dispensed with. It is also possible to provide the step plates 17 with a progressing numbering from 1 to 24, to further facilitate the orientation in the calendar.

For completing the Advent calendar which is shown in detail in FIGS. 2-5, the insert parts 7 and 8 of FIGS. 6 and 7 are provided with insert slots 21 and 22 corresponding to the insert slots 18 and 20. They are fitted or plugged on the elongation of the last or uppermost stair step 13, but in a vertical orientation, in contrast to the stair plates 17 and 19 which extend horizontally. An insertion region 23 occupied by the insertion slot 21 is shown in FIG. 2 in a broken line.

Figure 8:
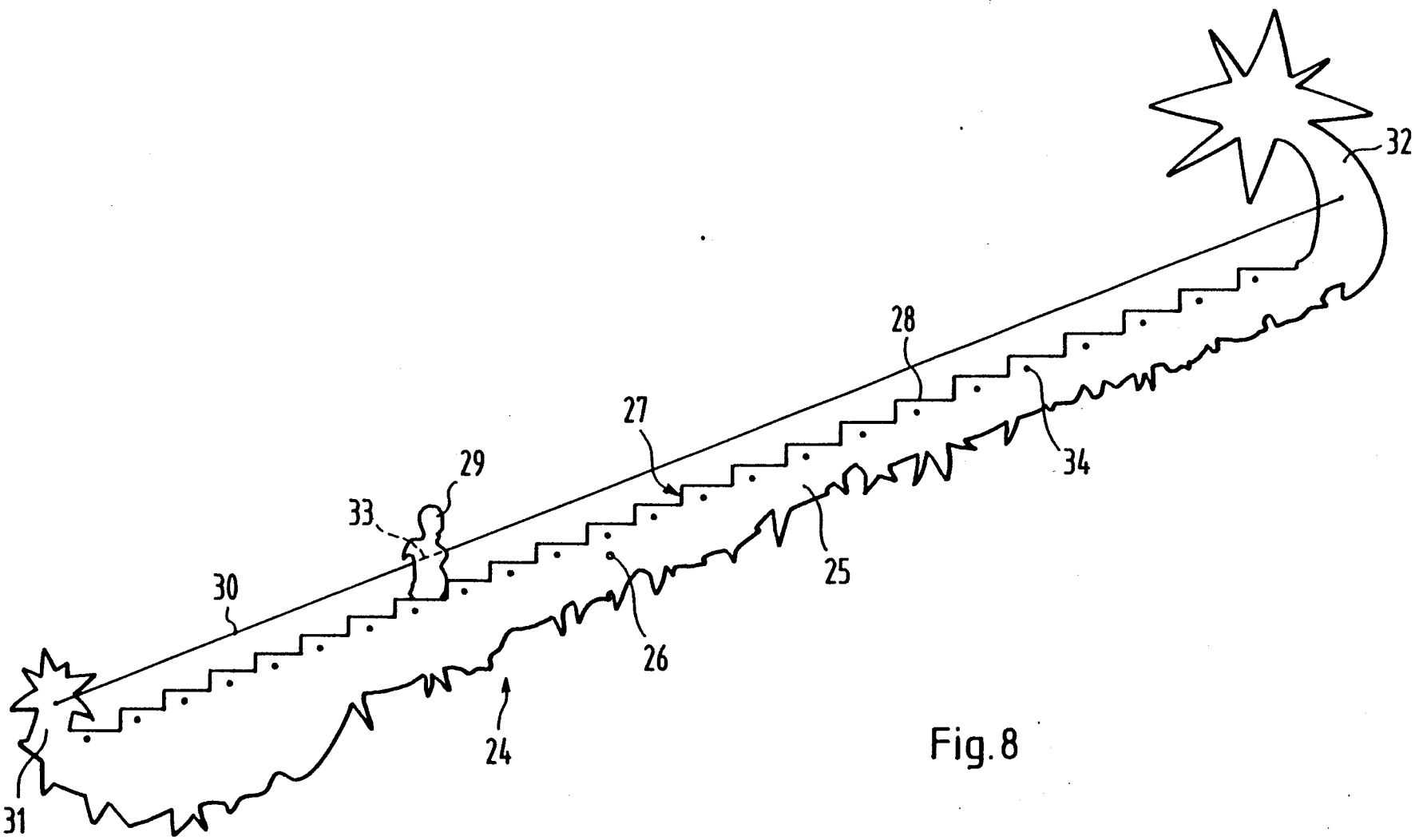
FIG. 8 is a side view of the Advent calendar formed as a wall calendar.

FIG. 8 shows another Advent calendar 24 which includes a flat calendar part 25 provided with an opening 26. Thereby the calendar 24 can be mounted on a wall by a single screw. The calendar part 25 also has star-like ornaments with star teeth which extend outwardly beyond the contour of the lower edge. The associated painting for completing the stars is not shown.

The calendar part 25 is provided with a stair edge 27 on its upper side and carries 24 stair steps 28. The latter are associated with the days from 1 to 24 of December.

Though the calendar part 25 is produced of a flat material having a small thickness, no wider step plates are provided. For preventing falling of the flat marking 29 in form of an angel from the stair steps 28 on which it is to be placed, a guide 30 in form a smooth filament or a wire is provided. The filament or wire is clamped between an extending lower end 31 and an extending upper end 32 which latter carries a star. The marking 29 or the angel has an opening 33 identified in a broken line and formed so that the guide filament or wire 30 extends through the opening. The angel can be pushed along the guide filament or wire 30 from one stair step to another without the risk of falling down.

As can be seen from FIG. 8 each stair step 28 has a projecting mounting device 34, formed for example as a pin or an ear. Bags or the like with small surprise gifts can be suspended on the mounting element 34. Disregarding this free gift, the daily movement of the angel 29 by one stair step 28 leads to unidirectional and indiscriminate stepping in raising direction or with raising figure. The Advent calendar in accordance with the present invention is especially suitable as a joint calendar for several kids which can move with full rights and in fully visible manner the angel by one stair step to the goal, namely the uppermost step which corresponds to the Christmas Night.

Figure 9:
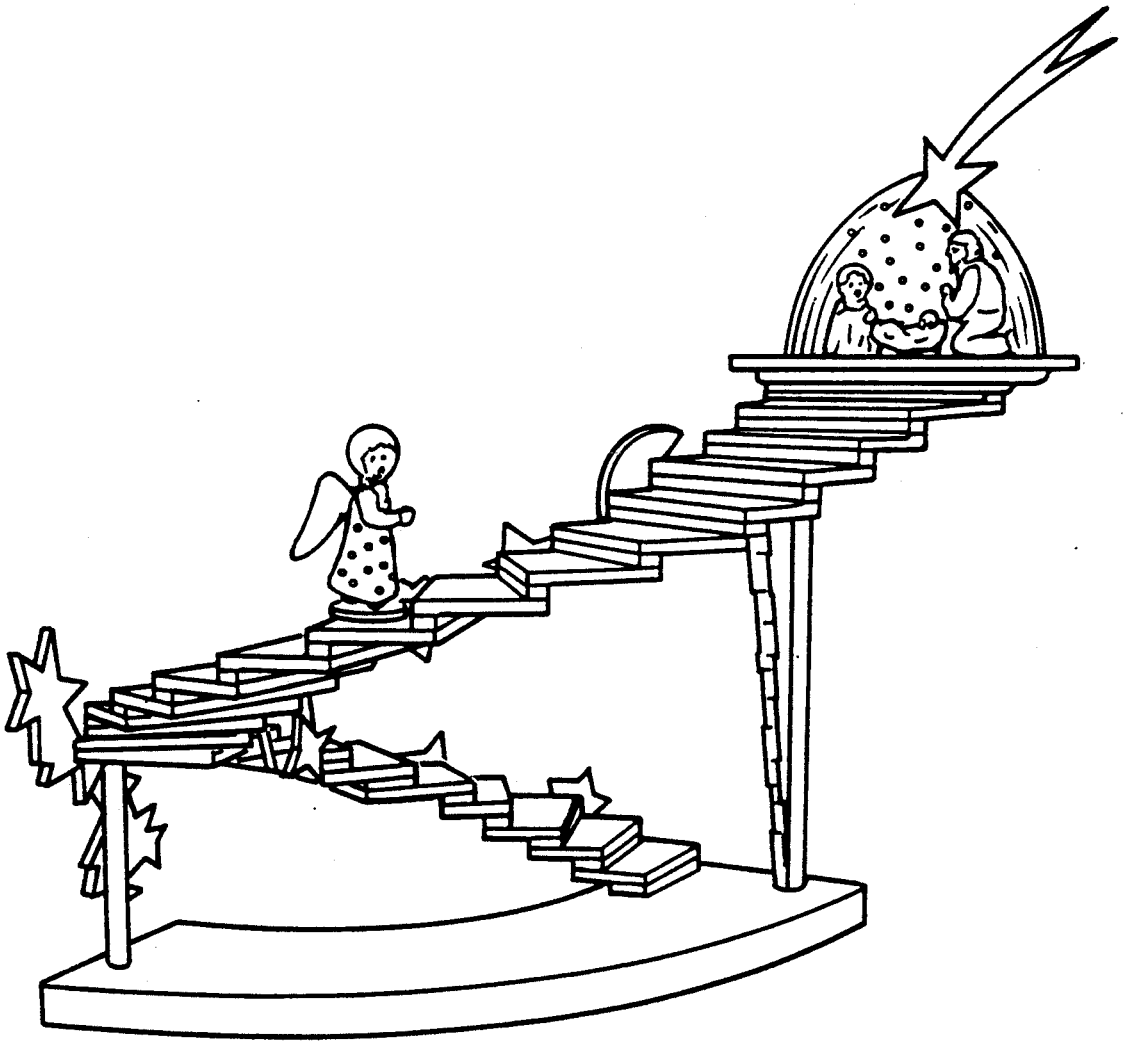
FIGS. 9 and 10 show a further embodiment of the invention.
Figure 10:
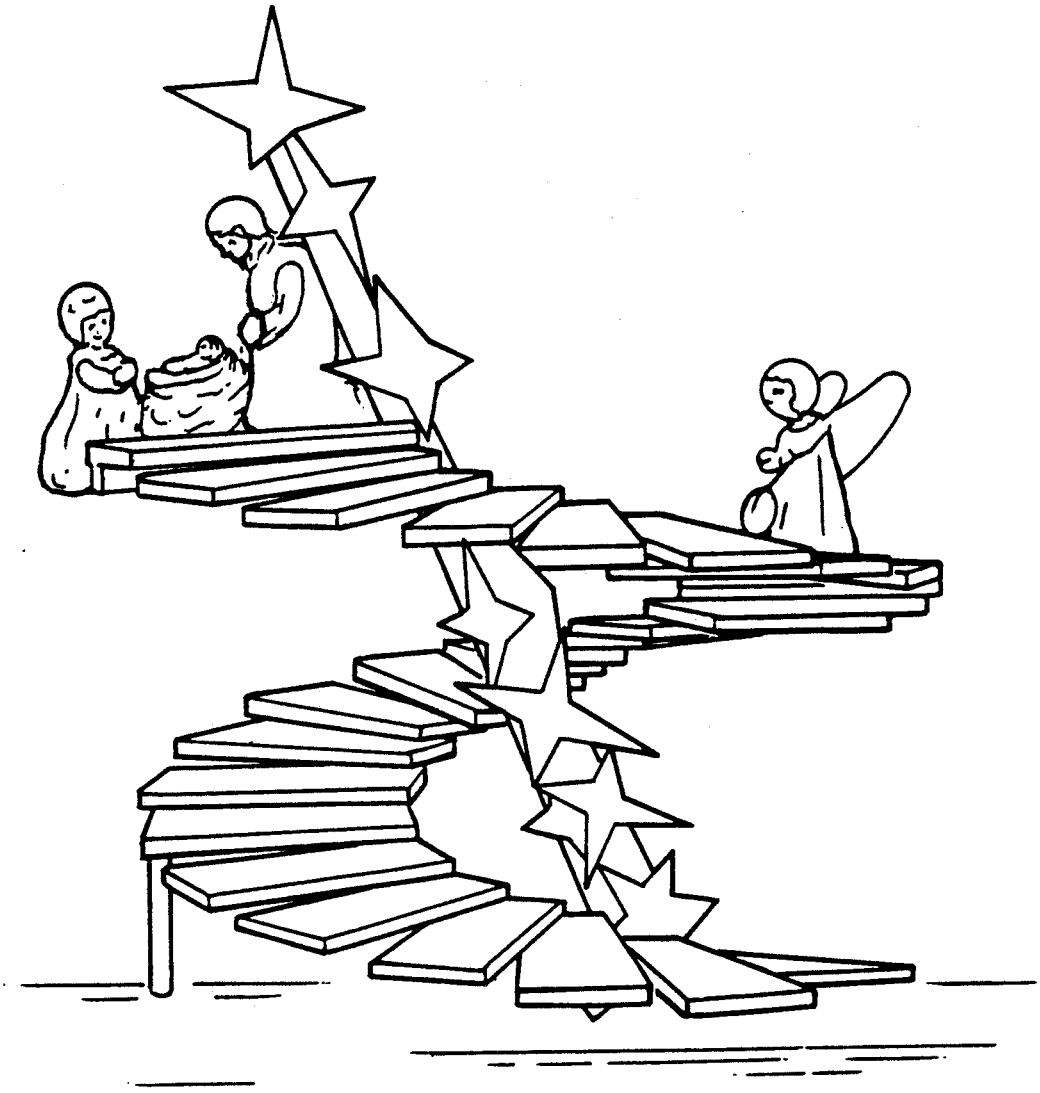

The calendar part with the stair edge can extend in a helical manner as shown in FIGS. 9 and 10. FIG. 11 shows an Advent calendar 35 corresponding to the calendar of FIG. 8, and the respective parts here are identified with the same reference numerals. However, in the Advent calendar of FIG. 11 there is no guiding filament 30 and opening 33 in the marking 37. For providing a reliable standing of the marking 37 in form of an angel on the stair steps 36, the stair steps are provided on their surface with a magnetic metal and the marking 37 is provided at its lower end with a permanent magnet 38.

The above described and shown Advent calendar as well as its parts can be composed of many materials for example wood, synthetic plastic material, metal or glass. For producing the individual insert or plug parts, especially wood or synthetic plastic material are desirable.

It will be understood that each of the elements described above, or two ore more together, may also find a useful application in other types of constructions differing from the types described above.

While the invention has been illustrated and described as embodied in a calendar, particularly an Advent calendar, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An Advent calendar, comprising a calendar part provided with a stair edge having stair steps which form respective day regions; a marking arranged to mark respective days, said stair steps and said markings being formed so that said marking can be consecutively arranged on said stair steps; orienting means for orienting said calendar part so that said stair steps extend each in a substantially horizontal direction and are spaced from one another horizontally and upwardly; a plurality of step plates arranged on said stair steps, said step plates being formed as plug parts which are releasably connectable with said calendar part.

2. A calendar as defined in claim 1, wherein said stair steps are provided with means for suspending small gifts.

3. A calendar as defined in claim 1, wherein said orienting means includes a foot part extending from said calendar part so that the calendar is in a standing position, said foot part projecting laterally beyond said calendar part.

4. A calendar as defined in claim 3, wherein said foot part is formed as a plug part which is releasably connectable with said calendar part.

5. A calendar as defined in claim 1, wherein said orienting means includes a suspending element for suspending said calendar part on a wall.

6. A calendar as defined in claim 1, wherein said calendar part with said stair edge extends in a substantially helical manner.

7. A calendar as defined in claim 1, wherein said stair steps include an uppermost stair step; and further comprising an additional plug part which is mounted on said uppermost stair step and has a Christmas motive.

8. A calendar as defined in claim 1, wherein said marking is formed as a standing figure.

9. A calendar as defined in claim 8, and further comprising a guide for guiding said standing figure during its movement along and above said stair edge.

10. A calendar as defined in claim 8, wherein said standing figure is provided with a permanent magnet, said stair steps being composed of a magnetic metal.

11. An Advent calendar, comprising a calendar part provided with a stair edge having stair steps which form respective day regions; a marking arranged to mark respective days, said stair steps and said markings being formed so that said marking can be consecutively arranged on said stair steps; orienting means for orienting said calendar part so that said stair steps extend each in a substantially horizontal direction and are spaced from one another horizontally and upwardly, said marking being formed as a standing figure; and a guide for guiding said standing figure during its movement along and above said stair edge, said guide being formed as a wire, said standing figure having an opening guided on said wire.

12. An Advent calendar, comprising a calendar part provided with a stair edge having stair steps which form respective day regions; a marking arranged to mark respective days, said stair steps and said markings being formed so that said marking can be consecutively arranged on said stair steps; orienting means for orienting said calendar part so that said stair steps extend each in a substantially horizontal direction and are spaced from one another horizontally and upwardly, said marking being formed as a standing figure; and a guide for guiding said standing figure during its movement along and above said stair edge, said guide being formed as a filament, said standing figure having an opening guided on said filament.

* * * * *